United States Patent [19]

Youngers

[11] 4,203,291

[45] May 20, 1980

[54] CONTROL MECHANISM FOR HYDROSTATIC PUMP

[75] Inventor: Stephen A. Youngers, Clearwater, Kans.

[73] Assignee: J. I. Case Company, Racine, Wis.

[21] Appl. No.: 25,019

[22] Filed: Mar. 29, 1979

[51] Int. Cl.[2] ..... F15B 11/16

[52] U.S. Cl. ..... 60/433; 60/484; 74/471 R; 91/521

[58] Field of Search ..... 60/433, 434, 484; 74/471 R; 91/521

[56] References Cited

U.S. PATENT DOCUMENTS

| | | | |
|---|---|---|---|
| 3,528,519 | 9/1970 | Case | 180/6.48 |
| 3,541,876 | 11/1970 | Gressard | 74/471 R |

*Primary Examiner*—Edgar W. Geoghegan

*Attorney, Agent, or Firm*—Dressler, Goldsmith, Shore, Sutker & Milnamow, Ltd.

[57] ABSTRACT

A control mechanism for controlling a reversible pump that selectively supplies fluid to two different motors forming separate functions includes a control lever pivoted about a fixed axis and having said pump connected thereto. A control console is located adjacent the control lever and cooperates therewith to define a plurality of distinct operating positions on opposite sides of a neutral position for said control lever. The control lever and control console also have releasable interlock means defining the neutral position for the control lever and the pump.

14 Claims, 3 Drawing Figures

CONTROL MECHANISM FOR HYDROSTATIC PUMP

DESCRIPTION

Technical Field

The present invention relates generally to control mechanism and more specifically to a control system for controlling the operation of a plurality of separate functions.

In designing vehicles, it has become customary for the vehicle to be specifically adapted to have a plurality of working components supported thereon to increase the versatility thereof. For example, one type of vehicle that is being marketed by the assignee of the present invention consists of an articulated frame that has a trencher supported on one section of the articulated frame and a cable plow, as well as a dozer blade supported on the other section. Many vehicles of this type also are designed so that either of the implements can be removed and other implements can be attached thereto.

One of the problems encountered with implements of this type is the fact that each implement must have a separate control system for precisely controlling the function of that particular implement.

BACKGROUND PRIOR ART

Numerous control systems have been proposed for controlling a plurality of independent functions and the most common type is commonly referred to as a "joy stick." In this type of control system, a single control lever is movable in two different angularly related planes to control different functions when moved along either plane. Examples of this type of control system are disclosed in U.S. Pat. Nos. 3,528,519 and 3,541,876.

Another problem encountered with designing the control system is the fact that many times a single hydraulic pump is utilized for supplying pressurized fluid to various different functions through suitable selector means. When utilizing a single control system for controlling a pump which supplies fluid to a plurality of functions, it may be necessary to operate the pump through different ranges and have different selected settings for the various control functions.

SUMMARY OF THE INVENTION

According to the present invention, a control system for a reversible pump consists of a single control lever that is movable to control a reversible pump through different ranges of operation for different functions that are being operated by the pump.

More specifically, the control system is designed for a vehicle that has a reversible pump supplying hydraulic fluid to at least two motors controlling separate functions with selector means or a selector valve between the motors and the pumps for selecting which function will be utilized. The control system consists of a single control lever that is pivoted about a fixed axis on the vehicle frame and is movable in opposite directions from a neutral position defined by interlock means between the frame and the control lever. A control console is located adjacent the control lever and cooperating means are defined on the control console and the lever that cooperates to define a plurality of distinct positions on each side of the neutral position of the control lever. The system is designed such that when the lever is moved in one direction from the neutral position, it operates one control function, such as supplying hydraulic fluid to a hydraulic trenching motor and, when moved in the opposite direction from the neutral position, it controls a second function such as a hydraulic motor forming part of a cable plow.

More specifically, the control console has an elongated slot through which the control lever projects and the control lever has a first portion pivoted on the fixed axis with a rod defining at least a part of the first portion and a second portion including a sleeve telescoped over the rod with biasing means between the portions. The second portion of the control lever also has projecting means or pins that are aligned with a plurality of apertures located in a plane parallel to the path of movement of the control lever so that the pins are biased into the apertures when aligned therewith. Thus, the pins and cooperating apertures define a plurality of distinct positions on either side of the neutral position for the control lever and the pump associated therewith.

The releasable interlock means between the control lever and the vehicle, more specifically, the control console, includes a safety quadrant supported on the first portion of the control lever and having a single opening therein. A safety pin or handle is slidably supported on the control console and has a free end biased towards the safety quadrant to be received therein whenever the control lever is moved to a neutral position. With the spring biased safety latch, movement across the neutral position is prevented since the latch will automatically be received into the opening to prevent any further movement thereof.

Therefore, the safety handle must be released before the operator can move the control lever from the neutral position and the control lever portions must be compressed to move the control lever from one position to another to remove the pins from the apertures.

DETAILED DESCRIPTION

Figure 1:
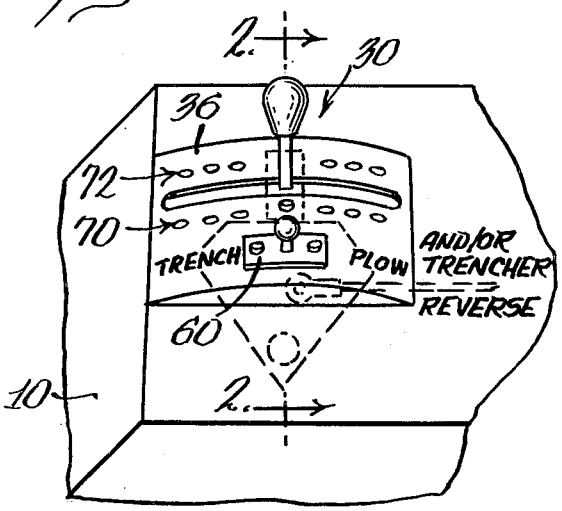
FIG. 1 is a fragmentary plan view of a portion of the vehicle having the control system of the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings shows a part of a frame 10 for a vehicle, the remainder of the vehicle not being illustrated. The vehicle may be of the type sold by the assignee of the present invention as a DH4 unit which is an articulated frame and has a first implement, such as a trencher, on one end thereof and a second implement, such as a cable laying plow, at the opposite end thereof. The trencher and the plow respectively have hydraulic motors 12 and 14 associated therewith and pressurized fluid is supplied to the respective hydraulic motors from a single hydraulic pump 16 supplying pressurized fluid in a closed loop path 18 to a selector valve 20. Pump 16 is preferably a reversible pump which is operated in one direction to operate one of the motors, such as motor 12, and operated in the opposite direction to operate the other motor 14.

According to the present invention, a single control unit is incorporated into the vehicle for separately controlling both motors independently. The control unit or system consists of a single control lever 30 which is pivoted about a fixed axis on vehicle frame 10 through a pivot pin 32. The control lever extends through an elongated slot 34 located in a control console 36 which forms part of vehicle frame 10 and is movable in opposite directions from a central neutral position illustrated in FIG. 1. The control lever includes a first portion 38 that is pivoted on pin 32 and portion 38 has a rod 40 at the upper free end thereof. Rod 40 is telescoped into a sleeve 42 forming part of a second portion 44 of the control lever 30 and the second portion has a control knob or handle 46 at the upper free end thereof. Biasing means in the form of a compression spring 48 is located between the first and second portions and more specifically between sleeve 42 and rod 40.

According to one aspect of the invention, the control console 36 and control lever 30 cooperate with each other to define a plurality of distinct positions on opposite sides of a neutral position and the neutral position is defined by a releasable interlock means between the frame, more particularly the control console and the control lever. Considering first the releasable interlock means, a quadrant or elongated member 50 is secured to the first portion 38 of control handle 30 and has a single opening 52 defined therein. A safety latch or pin 54 extends through spaced openings 56 defined on control console 36 and pin 54 is biased towards the upper surface of quadrant 50 through a spring 58 located between a plate 60 secured to the upper surface of the control console 36 and a washer 62 retained on an intermediate portion of pin 54 through a snap ring 64.

Figure 2:
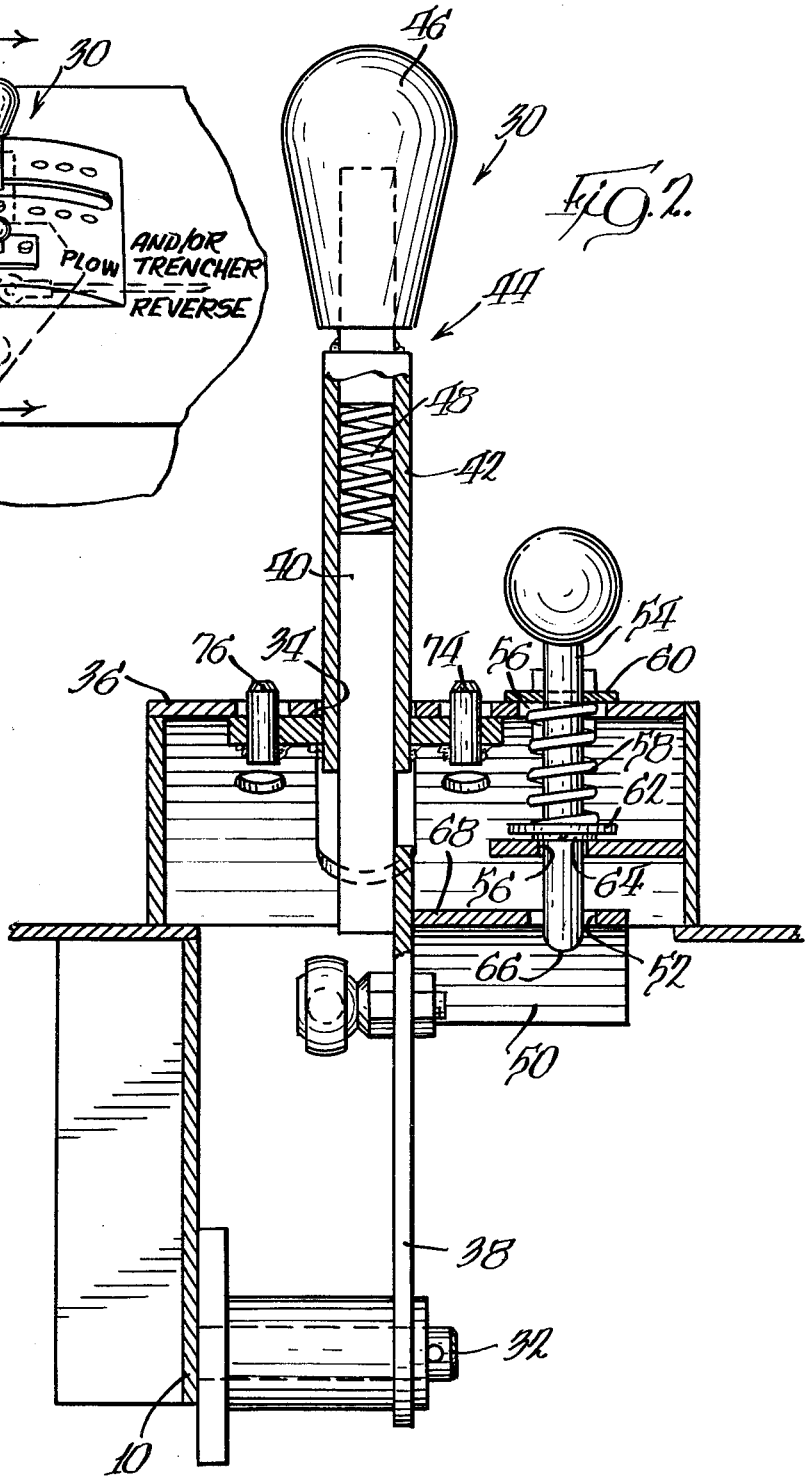
FIG. 2 is a fragmentary cross-sectional view as viewed along line 2—2 of FIG. 1.
Figure 3:
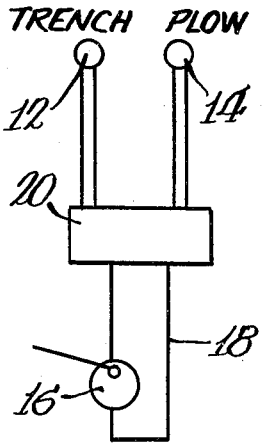
FIG. 3 is a hydraulic schematic for the hydrostatic system which is controlled by the control lever of the present invention.

Biasing means or spring 58 biases the free end 66 of pin 54 to a first position wherein the free end of the pin is located within opening 52 as illustrated in FIG. 2 and the free end of the pin has a second position in which it engages an upper surface 68 of quadrant 50. Thus, whenever the control lever is moved to a neutral position, the pin automatically is received into the opening and locks the control lever in the neutral position. In order for the operator to move the control lever from the neutral position he must physically grip the safety latch and move it from the first position to allow the control lever to then be moved from its neutral position.

The position defining means is illustrated in FIGS. 1 and 2 and includes first and second sets of apertures 70 and 72 that are respectively transversely aligned with each other and the respective apertures of the two sets are equally spaced from each other to define a plurality of distinct positions for the control lever on opposite sides of the neutral position. Control handle 46 has projection means in the form of a pair of pins 74 and 76 respectively aligned with the two sets of openings 70 and 72. The biasing means or spring 48 in control handle 30 biases the respective pins 74 and 76 towards the respective sets of apertures and forces the pins into the aperture when aligned therewith.

Considering now the operation of the control system, selector means or valve 20 is positioned such that the hydraulic circuit is conditioned for operating either the trencher motor 12 or the plow motor 14. After the mode has been selected, the operator can then physically grip the control knob of safety latch 54 and raise the latch to move the free end 66 out of opening 52. While the control or safety latch is in the second position, the operator then must compress spring 48 and move sleeve 42 of control lever 30 downwardly to move the pins 74 and 76 out of the apertures that define the neutral position. If the operator has selected the trenching function, the control lever is moved to the left as viewed in FIG. 1 to any of the three distinct positions defined by the three apertures on one side of the neutral position. While in any one of the operative positions, the safety latch or pin 54 is biased towards the upper surface 68 of the safety quadrant 50 and remains in that position while the control lever is in any position other than the neutral position. However, anytime the control lever is moved to the neutral position, the free end 66 of pin 54 is automatically received into the opening 52 and locks the control lever in the neutral position. This feature has significant advantages in that should it be necessary for the operator to immediately stop an operation, it is only necessary for him to compress the control handle and move the control handle towards the neutral position. Since the pin is received into the opening 52 as the control lever is moved to the neutral position, overtravel of the control lever is eliminated.

Of course, if the operator wants to utilize the second control function such as the vibratory cable laying plow, selector valve 20 is moved to a position to connect pump 16 and reservoir 18 to motor 14 and the control lever is moved to the right as viewed in FIG. 1.

One of the significant advantages of the present invention is that the range of operation for pump 16 can be accurately set by proper positioning of the apertures 70 and 72. For example, it has been found that when the two control functions are a trencher and a plow which respectively have hydraulic motors being supplied with fluid from a single pump, the flow and pressure requirements for the respective functions are different. For example, because of the nature of the design of the trencher, it is desirable to have relatively high flow rates to keep pressures as low as possible to the motor during the trenching operation while the vibratory plow preferably has fluid delivered at medium pressures and lower flow rates. This can readily be incorporated into the control lever by varying the arc of travel between the neutral position and the respective maximum positions for the control lever on opposite sides of the neutral position. For example, the arc of travel for the control lever between neutral and maximum positions in the plowing mode of operation may be substantially less than the arc of travel for the control lever between neutral and maximum positions for the trenching operation.

Of course, it will be appreciated that any number of positions may be defined on opposite sides of the neutral position and it will also be apparent that only a single projecting means and single set of apertures are necessary for defining the respective distinct positions of the control lever which is then a distinct setting for the output of the motor. It should also be pointed out that with the arrangement described, the motor is operated in one direction for one of the control functions and operated in the opposite direction for the other control function.

While the particular control system has been specifically described in connection with controlling two motors for two different functions, it is readily apparent that the control system can also be incorporated into other functions such as a reversible motor which forms part of the power train for a vehicle of this type.

What is claimed is:

1. In a vehicle having a reversible pump supplying hydraulic fluid to at least two motors controlling separate functions with selector means between said motors and said pump for selecting one function, said pump having a control arm movable in opposite directions from a neutral position, a control unit including a control lever pivoted on a fixed axis on said vehicle and having said arm connected thereto, releasable interlock means between said control lever and said vehicle defining a neutral position for said arm, a control console adjacent said control lever, said control console and control lever having a first position defining means defining a plurality of positions on one side of said neutral position for operating one selected motor at a plurality of levels of operation and second position defining means on an opposite side of said neutral position for operating the other selected motor at a plurality of levels of operation.

2. A vehicle as defined in claim 1, in which said releasable interlock means includes a quadrant carried by said control lever and having an opening and a spring biased pin biased toward said quadrant and received into said opening when said control lever is in a neutral position.

3. A vehicle as defined in claim 2, in which said control lever includes a first portion pivoted on said fixed axis and a second portion carried by said first portion with biasing means between said portions and in which said second portion has projection means forming part of said position defining means.

4. A vehicle as defined in claim 3, in which each position defining means includes a plurality of spaced apertures on each side of said neutral position.

5. A control unit for a reversible pump for controlling a function with said pump having a control arm movable in opposite directions from a neutral position to operate said function, said control unit including a control lever pivoted about a fixed axis on a frame and having said arm connected thereto at a location spaced from said fixed axis, a safety quadrant secured to said control lever and movable therewith, said safety quadrant having a single opening movable along a path with said control lever, a safety latch supported on said frame in said path and biasing means biasing said safety latch toward said quadrant, and position defining means defining a plurality of distinct positions for said control lever on said frame.

6. A control unit as defined in claim 5, in which said position defining means includes an elongated member adjacent said path and having a plurality of spaced apertures along said path and said control lever has a position defining element biased toward said member and aligned with said apertures.

7. A control unit as defined in claim 6, in which said control lever includes a first portion pivoted on said fixed axis and a second portion carried by said first portion with biasing means between said portions, said position defining element being supported on said second portion and biased toward said apertures.

8. A control unit as defined in claim 7, in which said elongated member has an elongated slot with said control lever movable along said slot, said elongated member having first and second sets of equally spaced apertures on opposite sides of said slot, said position defining element including first and second pins respectively secured to said second portion of said control lever and respectively aligned with said first and second sets of apertures.

9. A control unit as defined in claim 7, in which said first portion includes a rod extending through said elongated member and said second portion includes a sleeve telescoped over said rod with the biasing means between said rod and sleeve, said position defining element being secured to said sleeve between said elongated member and said fixed axis and biased toward said elongated member.

10. A control unit as defined in claim 5, in which said safety latch includes a pin biased to a first position wherein a free end of the pin is located in said opening, said free end having a second position engaging a surface of said safety quadrant in any position of said control lever other than said neutral position so that said pin is received into said opening when said control lever is moved to said neutral position.

11. A control unit as defined in claim 5, in which said pump is adapted to supply two motors respectively controlling first and second functions with selector means between said motors and pump for selecting one motor, and in which movement of the control lever in one direction from neutral controls one function, and movement of the control lever in an opposite direction from neutral controls the other function.

12. A control unit pivoted about a fixed axis on said vehicle, said vehicle including a control panel having an elongated slot through which said control lever projects, said control lever including a first portion pivoted on said fixed axis and a second portion telescoped on said first portion, said portions having overlapping segments located in said slot and biasing means between said portions, said control panel having a set of spaced apertures located in a plane extending parallel to said slot, said second portion having projection means aligned with said apertures so that said biasing means biases said projection means into an aperture when aligned therewith, and interlock means between said control panel and said control lever defining said neutral position.

13. A control unit as defined in claim 12, in which said apertures are located on one side of said slot and said control panel has a second set of apertures located on an opposite side of said slot, the apertures in the respective sets being transversely aligned and said projection means includes first and second pins respectively aligned with the respective sets of spaced apertures.

14. A control unit as defined in claim 12, in which said interlock means includes a safety quadrant fixed to said first portion and having a single opening therein, said control panel having a safety pin biased toward said quadrant and aligned with said opening to be received into said opening when said control lever is in a neutral position.

* * * * *